US009403374B2

(12) United States Patent
Suzuki et al.

(10) Patent No.: US 9,403,374 B2
(45) Date of Patent: Aug. 2, 2016

(54) RECORDING APPARATUS AND METHOD

(71) Applicant: SEIKO EPSON CORPORATION, Tokyo (JP)

(72) Inventors: Masato Suzuki, Shiojiri (JP); Naoki Sudo, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/644,436

(22) Filed: Mar. 11, 2015

(65) Prior Publication Data

US 2015/0266318 A1 Sep. 24, 2015

(30) Foreign Application Priority Data

Mar. 19, 2014 (JP) ..... 2014-056104

(51) Int. Cl.
*B41J 11/42* (2006.01)
*B41J 2/21* (2006.01)
*B41J 2/045* (2006.01)

(52) U.S. Cl.
CPC ..... *B41J 2/2135* (2013.01); *B41J 11/42* (2013.01); *B41J 2/04505* (2013.01)

(58) Field of Classification Search
CPC ..... B41J 2/2135; B41J 2/145; B41J 2/2132; B41J 2/04505; B41J 2/5056; B41J 11/42
See application file for complete search history.

(56) References Cited

U.S. PATENT DOCUMENTS 7,344,219 B2 3/2008 Sakamoto et al.
7,871,145 B1 * 1/2011 Enge ..... 347/19
2010/0245455 A1 * 9/2010 Mizes ..... B41J 2/2135 347/19

FOREIGN PATENT DOCUMENTS

JP 2007-038649 A 2/2007

* cited by examiner

*Primary Examiner* — Thinh Nguyen
(74) *Attorney, Agent, or Firm* — Maschoff Brennan

(57) ABSTRACT

A recording apparatus records an image onto a recording medium by repeating processes of: ejecting liquid from a nozzle in a liquid ejecting head while the liquid ejecting head is scanning the recording medium in a first direction; and transporting the recording medium in a second direction intersecting the first direction. This recording apparatus includes: an inclination acquisition section that acquires an inclination of the liquid ejecting head; and a recording controller that records a first image and a second image onto the recording medium through a first scan and a second scan independent of the first scan, respectively. The recording controller corrects a connection misalignment between the first and second images by displacing a recorded location of the second image in the first direction in accordance with the inclination, and reduces the displacement when a non-recorded region is present between the first and second images.

7 Claims, 14 Drawing Sheets

RECORDING APPARATUS AND METHOD

CROSS-REFERENCE TO RELATED APPLICATIONS

This application claims priority to Japanese Patent Application No. 2014-056104, filed on Mar. 19, 2014. The entire disclosure of Japanese Patent Application No. 2014-056104, is hereby incorporated herein by reference.

BACKGROUND

1. Technical Field

The present invention relates to a recording apparatus and a recording method.

2. Related Art

Ink jet printers (one type of recording apparatus) known in the art record images onto a recording medium by repeating two processes: a first process of ejecting liquid from nozzles in a liquid ejecting head over a period in which the liquid ejecting head is scanning the recording medium in a first direction (main scanning direction); and a second process of transporting the recording medium in a second direction (sub-scanning direction) that intersects the first direction. Ink jet recording apparatuses known in the art, if the recording head is inclined, divide a plurality of nozzles making up a nozzle array into some nozzle groups and then individually adjust a location of an image to be recorded by each nozzle group (see JP-A-2007-38649).

If the liquid ejecting head in an ink jet printer as described above is inclined, there are cases where an image that is made up of image elements recorded onto a recording medium through respective scans is not continuous. Consequently, when a user observes the resultant image recorded on the recording medium, he or she may feel that this image looks strange. If a non-recorded region (in which image elements are separated) is present in the resultant image, the image elements arranged with the non-recorded region therebetween may be greatly misaligned with each other.

SUMMARY

An advantage of some aspects of the invention is to provide a recording apparatus and a recording method that are effective in recording the image with high quality especially when a non-recorded region is present in an image.

A recording apparatus according to an aspect of the invention records an image onto a recording medium by repeating a process of ejecting liquid to the recording medium from a nozzle in a liquid ejecting head over a period in which the liquid ejecting head is scanning the recording medium in a first direction and a process of transporting the recording medium in a second direction intersecting the first direction. This recording apparatus includes: an inclination acquisition section that acquires an inclination of the liquid ejecting head; and a recording controller that records a first image and a second image onto the recording medium through a first scan and a second scan, respectively. The first scan and the second scan are independent of each other. This recording controller corrects a connection misalignment between the first image and the second image by displacing a recorded location of the second image in the first direction in accordance with the inclination. Furthermore, the recording controller reduces the displacement when a non-recorded region is present between the first image and the second image.

The foregoing configuration displaces the recorded location of a second image in a first direction in accordance with the inclination of a liquid ejecting head, being able to correct the connection misalignment between a first image and the second image. When a non-recorded region is present between the first image and the second image, this configuration reduces the displacement, thus suppressing the first and second images present with the non-recorded region therebetween from being misaligned with each other. With the configuration, therefore, high-quality images can be provided.

The recording controller preferably reduces the displacement so that an edge of the second image which is closer to the non-recorded region is positioned, in the first direction, nearer an edge of the first image which is closer to the non-recorded region. This configuration eliminates (or reduces) the displacement between a first image and a second image present with a non-recorded region therebetween. With this configuration, high-quality images can be provided.

When a width of the non-recorded region in the second direction is equal to or larger than a preset threshold regarding this width, the recording controller preferably reduces the displacement so that an edge of the second image which is closer to the non-recorded region is positioned, in the first direction, nearer an edge of a start image which is farther from the non-recorded region. Here, the start image is an image that has been recorded onto the recording medium through an initial scan. This configuration sets the displacement of the second image to approximately 0 when the width of a non-recorded region in a second direction is equal to or larger than a preset threshold, being able to provide a recorded result with a good entire image layout. Furthermore, the recording controller preferably variably reduces the displacement, depending on a location of the non-recorded region in the second direction. With this configuration, an occurrence of a situation in which setting the displacement of a second image to approximately 0 disadvantageously emphasizes the separation of images can be prevented.

The recording controller preferably divides an image data element that expresses an image element recorded onto the recording medium through a single scan into a plurality of divisional image data elements in the second direction in accordance with the inclination, then displaces the divisional image data elements away from one another in the first direction, and records an image of the displaced divisional image data elements onto the recording medium through the single scan. With this configuration, the respective inclinations of images (e.g., first image and second image) recorded through scans can be individually reduced when a liquid ejecting head is inclined.

When the non-recorded region is present between the first image and the second image, the recording controller divides an image data element corresponding to one of the first image and the second image into the plurality of divisional image data elements, and displaces one of the divisional image data elements which is farther from the non-recorded region with respect to another one of the divisional image data elements which is closer to the non-recorded region, the divisional data elements expressing the one of the first and second images. With this configuration, an occurrence of a situation can be prevented, in which dividing both a first image and a second image into divisional image data elements and displacing the divisional image data elements away from one another disadvantageously emphasize the separation of the first and second images (lowering their quality) present with a non-recorded region therebetween.

The technical spirit of the invention does not necessarily have to be embodied by only a recording apparatus as described above. For example, a recording method that includes process steps performed by individual sections in a recording apparatus can be deemed to be one invention. Moreover, the invention can be implemented using: a computer program that causes hardware (computer) to perform the process steps in the above recording method; a computer readable medium that stores this computer program; or other categories.

BRIEF DESCRIPTION OF THE DRAWINGS

The invention will be described with reference to the accompanying drawings, wherein like numbers reference like elements.

DESCRIPTION OF EXEMPLARY EMBODIMENTS

Some embodiments of the invention will be described in the following order.

Figure 1:
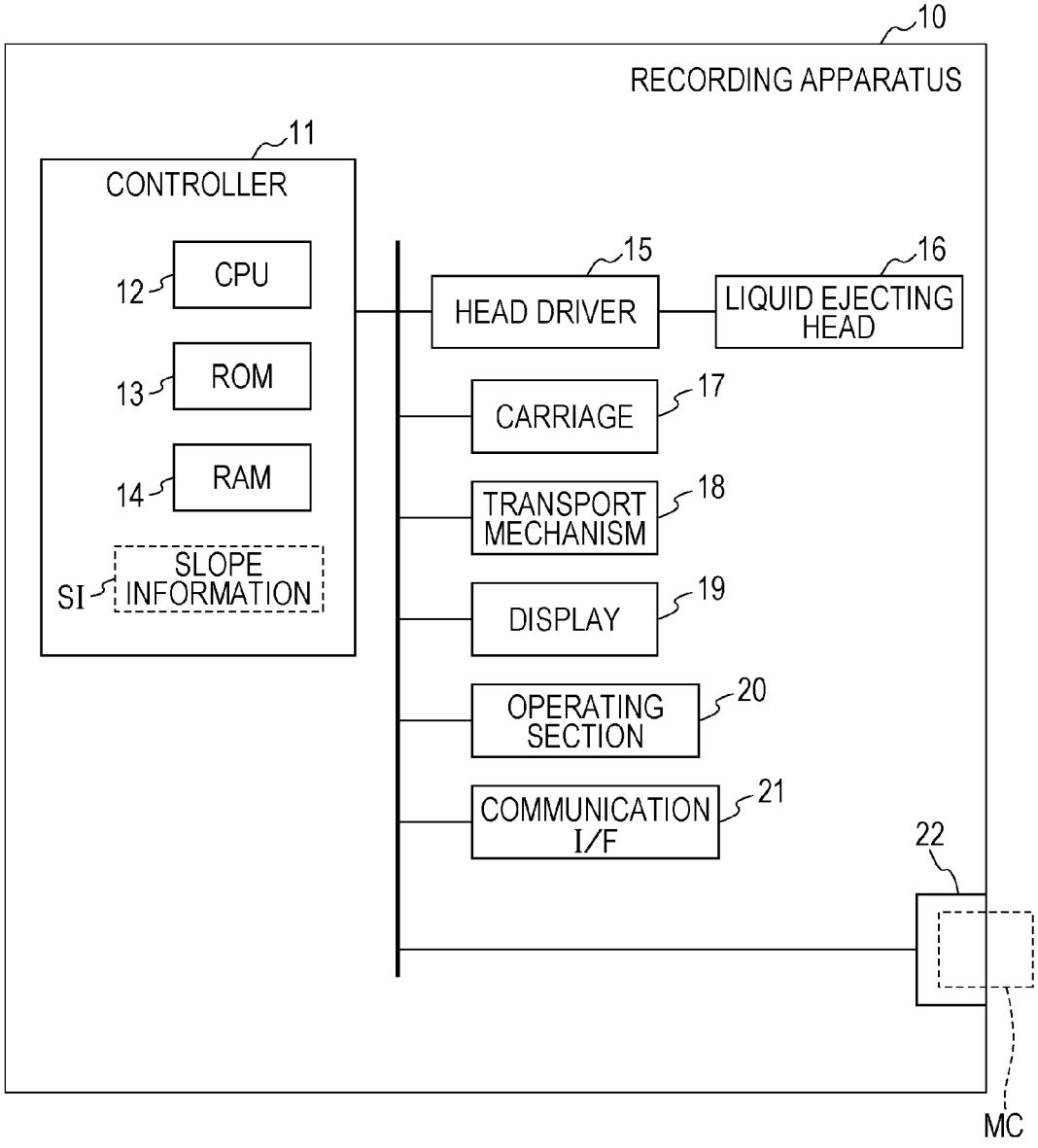
FIG. 1 schematically illustrates a configuration of a recording apparatus in first and second embodiments of the invention.

1. Schematic configuration of apparatus
2. First embodiment
3. Second embodiment
4. Other embodiments 1. Schematic Configuration of Apparatus FIG. 1 schematically illustrates a configuration of a recording apparatus 10 in first and second embodiments of the invention which performs a recording method. The following description will be given on the assumption that the recording apparatus 10 acts as an ink jet printer that ejects liquid from a plurality of nozzles. This recording apparatus 10 may also be referred to as, for example, a liquid ejecting apparatus or a print apparatus and implemented using a single apparatus or a combination of a plurality of apparatuses. The type of liquid ejected by the recording apparatus 10 is not limited to a specific one but typically an ink. The recording apparatus 10 has a controller 11, typically implemented using an IC, which controls the behavior of the recording apparatus 10 itself. In order for the controller 11 to control the recording apparatus 10, for example, a CPU 12 expands a program stored in a ROM 13 in a memory, such as a RAM 14, and makes a calculation in accordance with this program.

For example, an external appliance (not illustrated), such as a personal computer (PC), a server, a portable phone, a scanner or a digital still camera, can be connected to the controller 11 via a communication interface (I/F) 21 so that they conduct wired or wireless communication with each other, or an external memory medium can be inserted into the recording apparatus 10. Then, the controller 11 receives image data from such an external appliance or medium and performs a recording process in accordance with the image data. An exemplary insertion memory medium is a memory card MC, and this memory card MC can be inserted into a slot 22 formed in the exterior of the recording apparatus 10.

The recording apparatus 10 has a display 19, such as a liquid crystal panel, and an operating section 20. The operating section 20 includes various types of buttons and keys and a touch panel formed in the display 19. This operating section 20 receives various pieces of information required for a recording process which are input by a user. The display 19 provides a necessary user interface (UI) screen. The display 19 and the operating section 20 may be at least partially integrated with each other, constituting an operation panel.

The recording apparatus 10 has a transport mechanism 18. This transport mechanism 18 includes a roller and a motor that rotates the motor (both not illustrated), and intermittently transports a recording medium G in a predetermined direction under the control of the controller 11. Herein, the transport direction corresponds to a second direction and is also referred to as a sub-scanning direction; the recording medium G is typically a paper sheet but may be a sheet made of any given natural or artificial material, such as fiber, plastic or metal.

The recording apparatus 10 has a carriage 17 equipped with cartridges (not illustrated) that contain different types of liquids. For example, the cartridges in the carriage 17 contain a cyan (C) ink, a magenta (M) ink, a yellow (Y) ink, a black (K) ink and other colored inks. There is no limitation on the types and number of liquids used in the recording apparatus 10; however, for example, a light cyan ink, a light magenta ink, an orange ink, a green ink, a gray ink, a light gray ink, a white ink, a metallic ink or a precoat liquid may be used. Alternatively, the cartridges may be mounted in the recording apparatus 10 at a preset site instead of in the interior of the carriage 17; the carriages may be implemented using, for example, ink tanks or packages.

Figure 2:
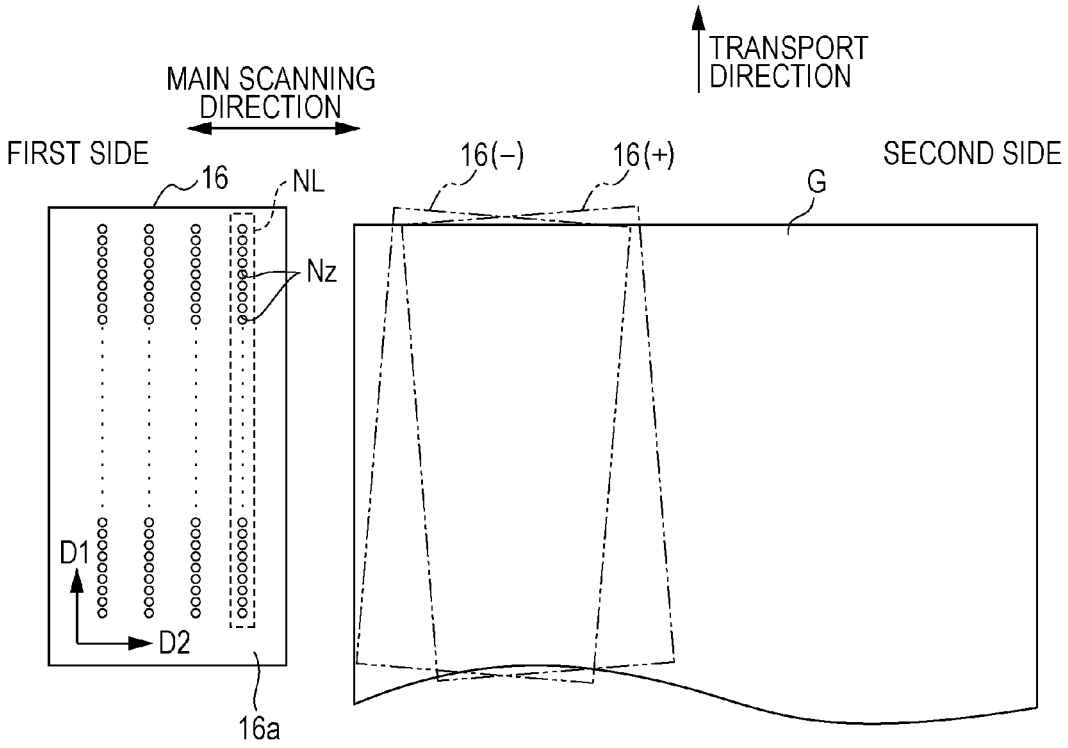
FIG. 2 illustrates an exemplary configuration of the liquid ejecting head and a recording medium in a simplified manner.

The carriage 17 moves from a first side of the recording medium G to a second side thereof in the main scanning direction that intersects the transport direction (at right angles) under the control of controller 11 (see FIG. 2). Herein, the main scanning direction corresponds to a "first direction." The carriage 17 is equipped with a liquid ejecting head 16 that has a plurality of nozzles from which the liquids supplied from the cartridges are ejected. The liquid ejecting head 16 is moved by the carriage 17.

FIG. 2 illustrates an exemplary configuration of the liquid ejecting head 16 in the recording apparatus 10 and the recording medium G in a simplified manner. Referring to the left part of FIG. 2, exemplary nozzles Nz are arrayed on an ejection surface 16*a* of the liquid ejecting head 16. This ejection surface 16*a*, on which the nozzles Nz are opened, faces the recording medium G while the liquid ejecting head 16 is moving in the main scanning direction. The ejection surface 16*a* assumes a lateral position when the recording apparatus 10 is installed on the lateral surface. The liquid ejecting head 16 has nozzle arrays NL corresponding to colored inks to be ejected, such as C, M, Y and K inks. Each nozzle array NL is made up of a plurality of nozzles Nz arrayed on the ejection surface 16*a* in a direction D1 at regular spacings. As illustrated in FIG. 2, the four nozzle arrays NL are arranged parallel to one another on the ejection surface 16*a* in a direction D2 that intersects the direction D1 at right angles. Each ink is ejected from a corresponding nozzle array NL; alternatively, for example, each ink may be ejected from a plurality of nozzle arrays NL arranged so as to be misaligned with one another in the direction D1. Herein, the words "intersection at right angles," "lateral," "regular spacings," "parallel," etc., which are used to specify the direction, position and the like of each component, should not be interpreted stringently; they may contain an error tolerated in terms of a product quality which would be generated during manufacturing processing.

The controller 11 subjects the image data, for example, that is made up of halftone image pixels in accordance with a predetermined color coordinate system, to known image processes, including a resolution conversion process, a color (color coordinate system) conversion process and a halftone process, thereby generating print data. The print data is also referred to as dot data. The print data generated in this manner is output to a head driver 15. This head driver 15 generates a drive signal in accordance with the received print data and supplies it to the liquid ejecting head 16. The liquid ejecting head 16 is provided with piezo elements corresponding to the nozzles, which cause the nozzles to eject the liquids. When each piezo element is supplied with the drive signal containing a pulse, it is deformed in response to this pulse, causing a corresponding nozzle to eject the liquid. Thus, the controller 11 determines whether to supply the drive signal to each individual piezo element, based on the print data.

Herein, the movement of the liquid ejecting head 16 over the recording medium G from the first side to the second side (or from the second side to the first side) in the main scanning direction is referred to as a "main scan" or "pass." The recording apparatus 10 repeats two processes: a first process of causing the liquid ejecting head 16 to eject the liquids from the nozzles over a period in which the liquid ejecting head 16 is performing the main scan on the recording medium G; and a second process of transporting the recording medium G in the transport direction. Repeating these processes in this manner forms dots on the recording medium G, producing an image based on the image data. The word "dot" basically denotes a liquid (droplet) ejected to and landed on a recording medium. However, the word "dot" will be used before a droplet is ejected to or landed on a recording medium, for the sake of an explanation. Note that in the recording apparatus 10, a mechanism for ejecting liquids from the nozzles may employ not only the piezo elements but also heater elements that heat liquid.

An exemplary liquid ejecting head 16 depicted in the left part of FIG. 2 by a solid line is not inclined. The expression "the liquid ejecting head 16 is not inclined" indicates, for example, a state where the direction D1 of the liquid ejecting head 16 coincides with the transport direction (the direction D2 of the liquid ejecting head 16 coincides with the main scanning direction). For comparison, exemplary rectangles depicted over the recording medium G by a dashed-dotted line and a dashed-two dotted line in FIG. 2 each represent an inclined liquid ejecting head 16. Ideally, the liquid ejecting head 16 is not inclined when being installed in the main body of a printer (recording apparatus 10), but in fact it is difficult to install them in all types of commercial printers in this manner. So, it can be said that liquid ejecting heads 16 are always inclined in printers. A liquid ejecting head 16 (+) indicated by the dashed-dotted line in FIG. 2 is slightly inclined counterclockwise, and this counterclockwise inclination is referred to as a "positive inclination." A liquid ejecting head 16 (−) indicated by the dashed-two dotted line in FIG. 2 is slightly inclined clockwise, and this clockwise inclination is referred to as a "negative inclination."

2. First Embodiment

Figure 3:
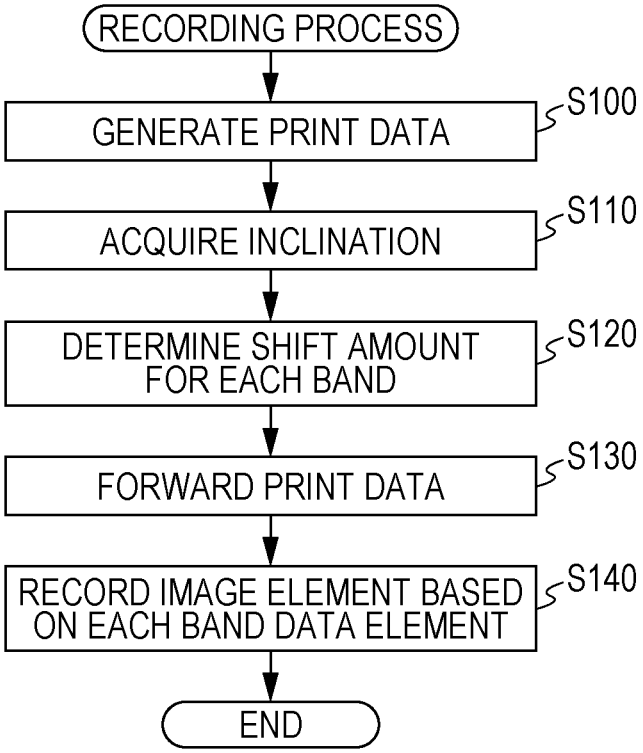
FIG. 3 is a flowchart of a recording process.

In light of the configuration described above, the first embodiment of the invention will be described. FIG. 3 is a flowchart of a recording (printing) process performed by the recording apparatus 10. At Step S100, as described above, the controller 11 generates the print data from the image data. This print data is bitmap data, for example, or data (dot data) that specifies the ejection of an ink (formation of a dot) or the non-ejection of an ink (non-formation of a dot) at each individual pixel.

At Step S110, the controller 11 acquires the inclination of the liquid ejecting head 16. In this case, there is no limitation on a method of acquiring the inclination of the liquid ejecting head 16; any given method of acquiring resultant information that directly or indirectly indicates the inclination of the liquid ejecting head 16 may be acquired. For example, the printer (recording apparatus 10) may be provided with a predetermined memory that stores a slope information SI regarding the inclination of the liquid ejecting head 16. Specifically, after the liquid ejecting head 16 has been installed and before the printer is placed on the market, the inclination (e.g., an inclination side (positive or negative side) and an inclination amount) of the liquid ejecting head 16 in the printer is measured, and this measurement is stored in the memory as the slope information SI (see FIG. 1). If the recording apparatus 10 already stores the unique slope information SI, the controller 11 only has to read it. Alternately, at Step S110, the controller 11 may cause the recording apparatus 10 to print a test pattern and then acquire (receive) the inclination of the liquid ejecting head 16 through automatic measurement or a user's evaluation based on the printed result of the test pattern. Step S110 may be performed at any given timing before Step S120 that will be described below. For example, Step S110 may be performed before Step S100. It can be said that the controller 11, which performs the process at Step 5110, functions as an "inclination acquisition section."

At Step S120, the controller 11 determines an "inter-band shift amount," based on the inclination acquired at Step S110. In this embodiment, the recording apparatus 10 performs band printing. The word "band printing" refers to a process of printing an image for a page onto a recording medium by repeatedly recording an image element onto a unit region (band) through a single pass, the unit region having a width substantially corresponding to the length of each nozzle array NL in the transport direction. During this band printing, the recording medium G is basically transported by an amount corresponding to the width of each band at intervals between passes.

Figure 4A:
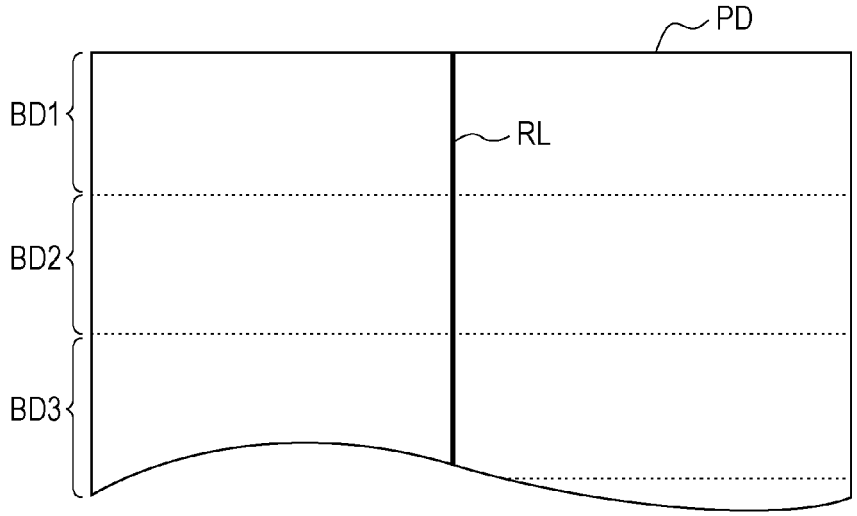
FIGS. 4A and 4B each illustrate a part of exemplary print data.
Figure 5A:
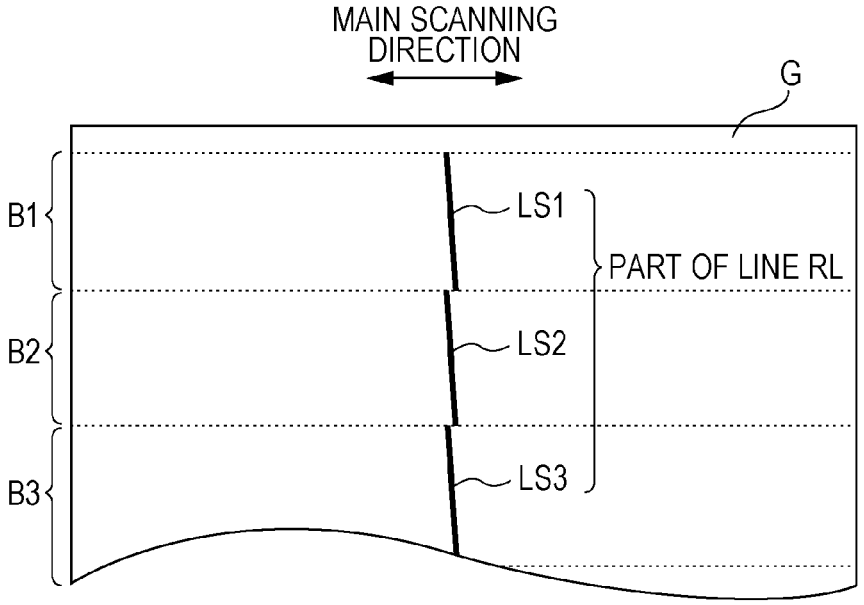
FIG. 5A illustrates an exemplary recorded result when no shift amount is applied to each band.

FIG. 4A illustrates a part of exemplary print data PD generated at Step S100. It is assumed that this print data PD contains a line RL (the cluster of pixels specifying formation of dots that make up the line RL) which extends in the transport direction. The print data PD is divided into band data elements BD1, BD2, BD3 and so on, each of which corresponds to a single band, and each band data element is recorded through a single pass. Herein, the band data element corresponds to image data that expresses an image element to be recorded onto a recording medium through a single scan. The line RL extends across the band data elements BD1, BD2, BD3 and so on. Suppose the liquid ejecting head 16 is positively inclined; the line RL is made up of the cluster of respective results of recording the band data elements BD1, BD2, BD3 and so on (bands B1, B2, B3 and so on) onto the recording medium G. As illustrated in FIG. 5A, the line RL is made up of line segments LS1, LS2, LS3 and so on, each of which is inclined in accordance with the positive inclination of the liquid ejecting head 16. These line segments LS1, LS2, LS3 and so on are not connected to one another and accordingly do not constitute a single line. In order to correct this discontinuity of the line segments LS1, LS2, LS3 and so on in the bands as illustrated in FIG. 5A, the controller 11 first determines the shift amount BS for each band at Step S120.

If the width of a band (which is nearly equal to the length of each nozzle array NL) is denoted by BH and an inclination amount indicated by the slope information SI is denoted by θ, the controller 11 calculates a shift amount BS by using equation (1) described below (see FIG. 6).

$$BS=BH\cdot\sin\theta \quad (1)$$

Figure 6:
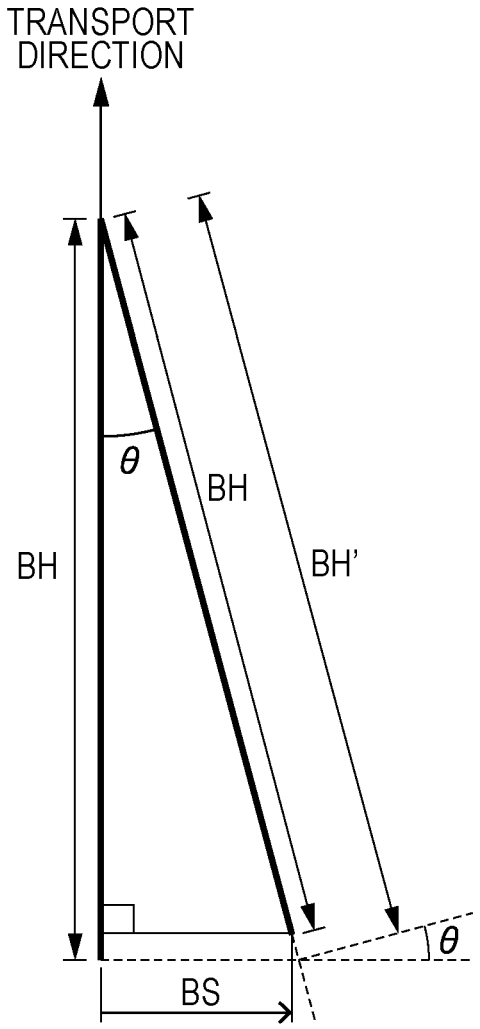
FIG. 6 is an illustrative diagram of a method of calculating a shift amount for each band.

In FIG. 6, the inclination amount θ denotes the angle that the direction D1 (the direction in which the nozzle arrays NL extend) forms with the transport direction, and the length BH' denotes the length of a line forming the angle θ with the transport direction within a region where the width in the transport direction is equal to the width BH of a band. In this case, a more accurate shift amount BS for each band could be acquired from the equation (BH'·sin θ) instead of equation (1). However, the inclination amount θ depicted in FIG. 6 is exaggerated (increased), and the actual angle θ is much smaller. For this reason, no problem would occur even if the shift amount BS is calculated from equation (1) under the condition of (BH'·sin θ≈BH·sin θ).

Next, the controller 11 determines the inter-band shift amount, based on the shift amount BS. More specifically, the controller 11 basically determines a shift amount BSn for a band data element BDn by using equation (2) described below. Here, the band data element BDn is the n-th band data element (n is a natural number of 1 or more) counted from the front.

$$BSn=(n-1)\cdot BS \quad (2)$$

According to equation (2), the shift amounts BS1, BS2 and BS3 for the band data elements BD1, BD2 and BD3 are 0, 1×BS and 2×BS, respectively. If the slope information SI indicates a positive inclination, the controller 11 determines a positive shift amount BSn for the band data element BDn. If the slope information SI indicates a negative inclination, the controller 11 determines a negative shift amount BSn for the band data element BDn.

At Step S130, the controller 11 forwards the print data PD to the head driver 15 in units of the band data elements. These band data elements contain information regarding the respective shift amounts (BS1, BS2, BS3 and so on) determined at Step S120. The head driver 15 receives the band data elements and then temporarily stores them in a predetermined buffer.

At Step S140, both the head driver 15 and the liquid ejecting head 16 cooperate to record an image element based on the band data elements that have been received and temporarily stored at Step S130. More specifically, the head driver 15 generates a drive voltage to be applied to the nozzles (the piezo elements in the nozzles) over the period of a pass in which the image element based on each band data element is recorded, in accordance with the locations of pixels. Here, the pixels constitute the band data elements temporarily stored and specify formation of dots. Then, the head driver 15 applies the drive voltage to the liquid ejecting head 16, recording the image elements based on the corresponding band data elements onto the recording medium G through respective passes. The head driver 15 adjusts the timing at which the image element based on the band data element BDn is recorded (liquid is ejected), in accordance with the shift amount BSn. If the shift amount BSn is negative, the head driver 15 displaces the liquid ejection site based on the band data element BDn toward the first side (see FIG. 2) of the recording medium G in the main scanning direction by the shift amount BSn. If the shift amount BSn is positive, the head driver 15 displaces the liquid ejection site based on the band data element BDn toward the second side (see FIG. 2) of the recording medium G in the main scanning direction by the shift amount BSn.

Figure 5B:
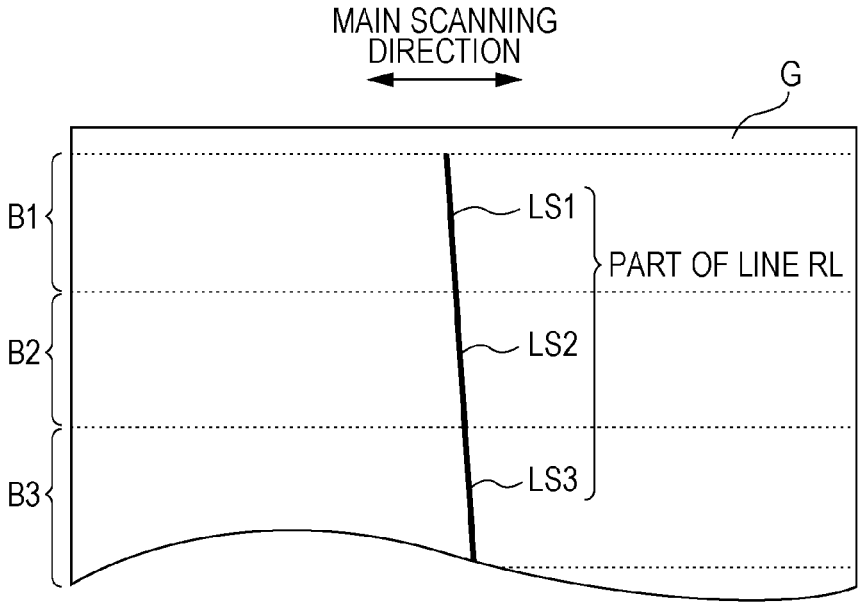
FIG. 5B illustrates an exemplary recorded result in the first embodiment.

FIG. 5B illustrates an exemplary recorded result in this embodiment. As described above, the recording apparatus 10 adjusts the timing at which the image element based on each band data element is recorded in the main scanning direction through a single pass, in accordance with the (positive or negative) shift amount for each band which depends on the inclination of the liquid ejecting head 16. In this case, the line RL, which is made up of the respective results of recording the band data elements BD1, BD2, BD3 and so on (bands B1, B2, B3 and so on) onto the recording medium G, are produced as a single line in which line segments LS1, LS2, LS3 and so on inclined depending on the inclination of the liquid ejecting head 16 are connected to each other, as illustrated in FIG. 5B. In this way, the discontinuity of line segments, as described in FIG. 5A, is corrected.

For the recording apparatus 10, one of passes in which band data elements are recorded corresponds to a first scan or a second scan. For example, suppose a pass in which the band data element BD1 (FIG. 4A) is recorded is defined as a first scan. The band B1 (FIG. 5B), which is a result of recording the band data element BD1, corresponds to a "first image." A pass in which the band data element BD2 (FIG. 4A) coming immediately after the band data element BD1 is recorded corresponds to a "second scan." The band B2 (FIG. 5B), which is a result of recording the band data element BD2, corresponds to a "second image." Likewise, suppose a pass in which the band data element BD2 (FIG. 4A) is recorded is defined as a first scan. The band B2 (FIG. 5B) corresponds to a "first image." A pass in which the band data element BD3 (FIG. 4A) coming immediately after the band data element BD2 is recorded corresponds to a "second scan." The band B3 (FIG. 5B) corresponds to a "second image."

In light of the above, it can be said that both the controller 11 and the head driver 15, which perform Steps S120, S130 and S140, function as a "recording controller" that records the first image onto the recording medium G through the first scan and then records the second image onto the recording medium G through the second scan that differs from the first scan. As described above, this recording controller displaces a recorded site of the second image in the first direction (main scanning direction) in accordance with the inclination of the liquid ejecting head 16 (by the shift amount BSn). This can correct the misalignment between the first image and the second image (can correct the discontinuity of the line segments LS1, LS2, LS3 and so on (see FIG. 5A) contained in the bands B1, B2, B3 and so on, respectively, thus providing a recorded result as illustrated in FIG. 5B).

If a non-recorded region is present between the first image and the second image, the recording controller in this embodiment reduces the shift amount for the second image, as will be described below. More specifically, when the controller 11 determines the shift amount for each band in the above manner at Step S120, it determines whether or not a non-recorded region is present in the print data. The word "non-recorded region" refers to a region in which no dots are to be formed and will be referred to below as a "blank."

Figure 4B:
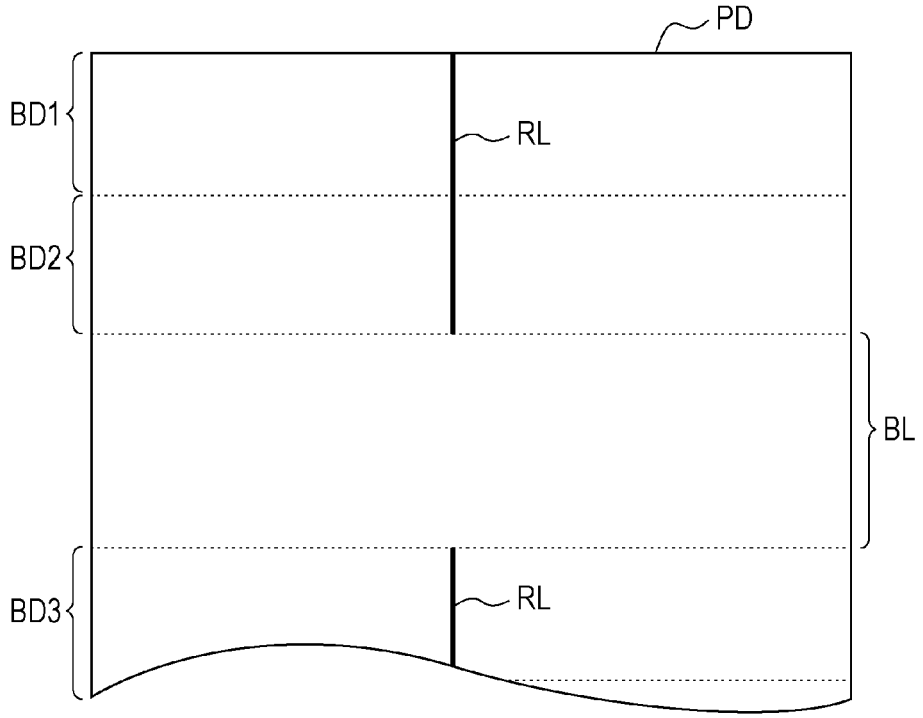

FIG. 4B illustrates a part of exemplary print data PD generated at Step S100 which contains a blank BL. In the example of FIG. 4B, a band data element BD2 is present and following this, a blank BL, the width of which is approximately 1.5 times the width of each band, is present. Lines RL are separated from each other with the blank BL therebetween. If the presence of the blank BL is detected at Step S120, the controller 11 sets the band data elements and skips the blank BL. For example, in the example of FIG. 4B, regions coming after the blank BL are set as a band data element BD3 and so on. Then, the controller 11 sets the shift amounts for the band data element BD3 and so on that come after the blank BL so that they become smaller than the shift amounts according to the actual locations of the band data element BD3 and so on within the print data PD.

The expression "the shift amounts according to the actual locations of the band data element BD3 and so on within the print data PD" refers to the shift amount determined in consideration of the width of the blank BL. More specifically, the shift amount for the band data element BD2 preceding the blank BL is 1×BS. Then, if the blank BL is regarded as a band data element containing any given image, the shift amount for the blank BL is 2×BS. Thus, the shift amount for the band data element BD3 coming immediately after the blank BL which is determined based on its actual location is 3.5×BS; this value is obtained by adding the shift amount (1.5×BS) according to the width (1.5 times band width) of the blank BL to 2×BS.

Figure 7A:
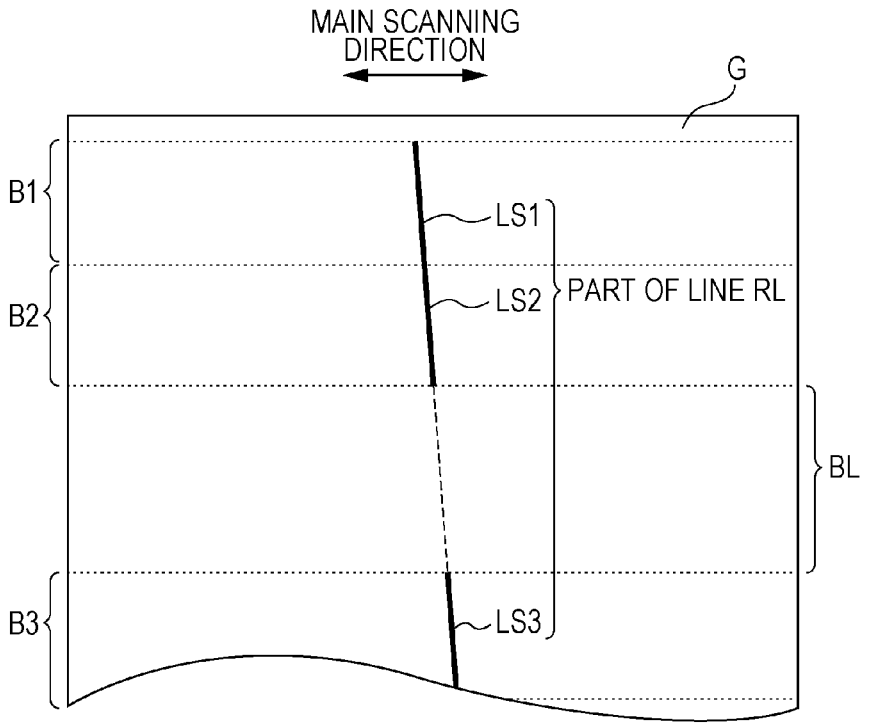
FIG. 7A illustrates an exemplary recorded result when a blank is present but a shift amount is not reduced.

FIG. 7A illustrates an exemplary recorded result of applying the shift amount for a band data element BD3 which is determined based on its actual location in the above manner to a pass in which the band data element BD3 is recorded. When the shift amount for the band data element BD3 which is determined based on its actual location is applied, a line segment LS3 contained in a band B3 is the extension of line segments LS1 and LS2 contained in bands B1 and B2, respectively. Note that the dashed line extending within a blank BL in FIG. 7A is used for the sake of convenience in order to show the extension of the line segments LS1 and LS2 and is not actually recorded.

As described above, the controller 11 sets the shift amounts for the band data element BD3 and so on that come after the blank BL so that they become smaller than the shift amounts according to the actual locations of the band data element BD3 and so on within the print data PD. More specifically, the shift amount for the band data element BD2 preceding the blank BL is 1×BS, whereas the shift amount for band data element BD3 coming after the blank BL is 2×BS in which case the presence of the blank BL is ignored (the band data element BD3 is regarded as coming immediately after the band data element BD2).

Figure 7B:
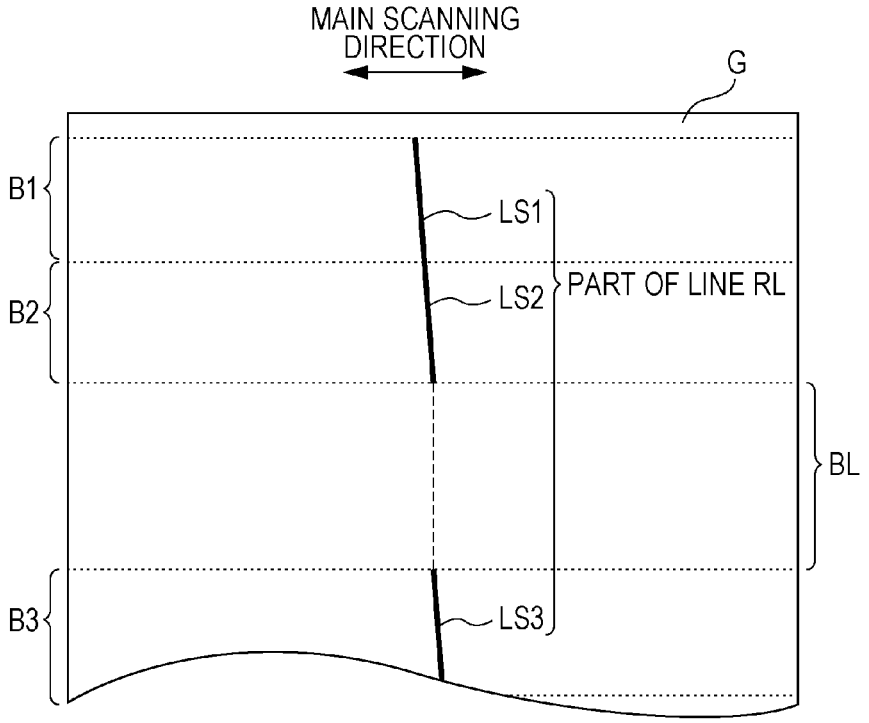
FIG. 7B illustrates an exemplary recorded result in the first embodiment when a blank is present.

FIG. 7B illustrates an exemplary recorded result of applying the shift amount for a band data element BD3 that comes after a blank BL which is determined in this embodiment to a pass in which the band data element BD3 is recorded. According to this embodiment, the edge of a line segment LS3 contained in a band B3 coming immediately after the blank BL which is closer to the blank BL is substantially aligned, in the main scanning direction, with the edge of a line segment LS2 contained in a band B2 preceding the blank BL which is closer to the blank BL. Note that a dashed line extending within the blank BL in FIG. 7B is used for the sake of convenience in order to show a line that passes through the edge of the line segment LS2 on the blank BL side parallel to the transport direction and is not actually recorded. In can be said from the example of FIG. 7B that the recording controller sets the shift amount for the band data element BD3 so as to become smaller than that in the example of FIG. 7A. Consequently, assuming that the edge of the second image (the line segment LS3 contained in the band B3 in FIG. 7B) which is closer to the blank BL is a first edge and the edge of the first image (the line segment LS2 contained in the band B2 in FIG. 7B) which is closer to the blank BL is a second edge, the first edge is positioned nearer the second edge in the main scanning direction.

Comparing the examples of FIGS. 7A and 7B, the shift amount in the main scanning direction in FIG. 7B at which parts (line segments LS2 and LS3) of the line RL recorded with the blank BL therebetween are displaced from each other is smaller than that in FIG. 7A. Thus, it can be said that the example of FIG. 7B provides a user with a higher quality image. In the description given with reference to FIGS. 5A to 7B, the liquid ejecting head 16 is assumed to be positively inclined. Accordingly, the shift amount for the band B3 in the example of FIG. 7B is compensated for toward the second side of the recording medium G in the main scanning direction, as opposed to the example of FIG. 7A. Assuming that the liquid ejecting head 16 is negatively inclined, the shift amount for the band B3 in the example of FIG. 7B is compensated for toward the first side of the recording medium G in the main scanning direction.

The invention is not limited to the embodiment described above; however various aspects are possible without departing from the spirit of the invention. For example, some other embodiments that will be described below can be employed. A combination of two or more of such embodiments also falls within the disclosure of the invention.

3. Second Embodiment

A recording process (print process) performed by the recording apparatus 10 in the second embodiment will also be described with reference to the flowchart of FIG. 3. Specifically, the description of the second embodiment will be centered on different parts from the first embodiment, and the same part will not be described as appropriate. The second embodiment differs from the first embodiment in that an "in-band pixel shift" is performed in accordance with the inclination of the liquid ejecting head 16 and the "inter-band shift amount" is determined in consideration of this pixel shift.

Figure 8:
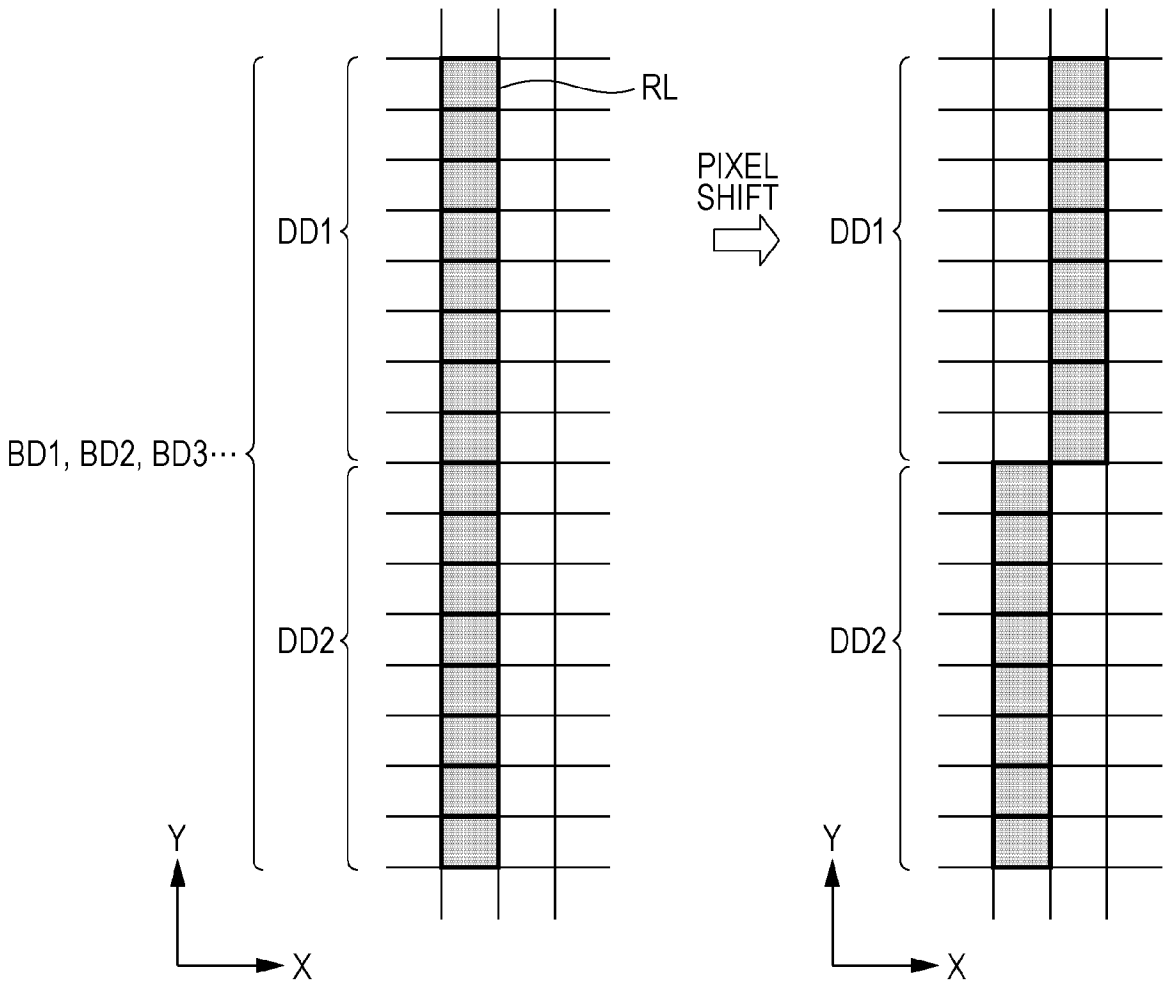
FIG. 8 is an illustrative diagram of a pixel shift when the liquid ejecting head is positively inclined.

FIG. 8 is an illustrative diagram of the in-band pixel shift when the liquid ejecting head 16 is positively inclined. In the left part of FIG. 8, a part of a band data element (one of band data elements BD1, BD2, BD3, etc.) which is to be recorded through a single pass is illustrated. In other words, a region composed of pixels mainly constituting a line RL (a segment of the line RL) is illustrated. In FIG. 8, the direction X corresponds to the direction from the first side of the recording medium G to the second side in the main scanning direction in accordance with a coordinate system in which image data (print data) is handled; the direction Y corresponds to the transport direction in accordance with this coordinate system. In FIG. 8, the rectangles correspond to pixels, and in particular, gray ones of the rectangles correspond to pixels constituting the line RL.

In performing the "in-band pixel shift," each band data element is divided into a plurality of divisional image data elements (divisional data elements) in the direction Y corresponding to the transport direction. Referring to the example of FIG. 8, the band data element is divided into two parts disposed on the front and rear sides, respectively, of the print data PD in the transport direction; the front part is a divisional data element DD1 and the rear part is a divisional data element DD2. Then, the entire front divisional data element DD1 is displaced from the front divisional data element DD2 in the direction X by a preset number of pixels (one pixel in the second embodiment).

Figure 9:
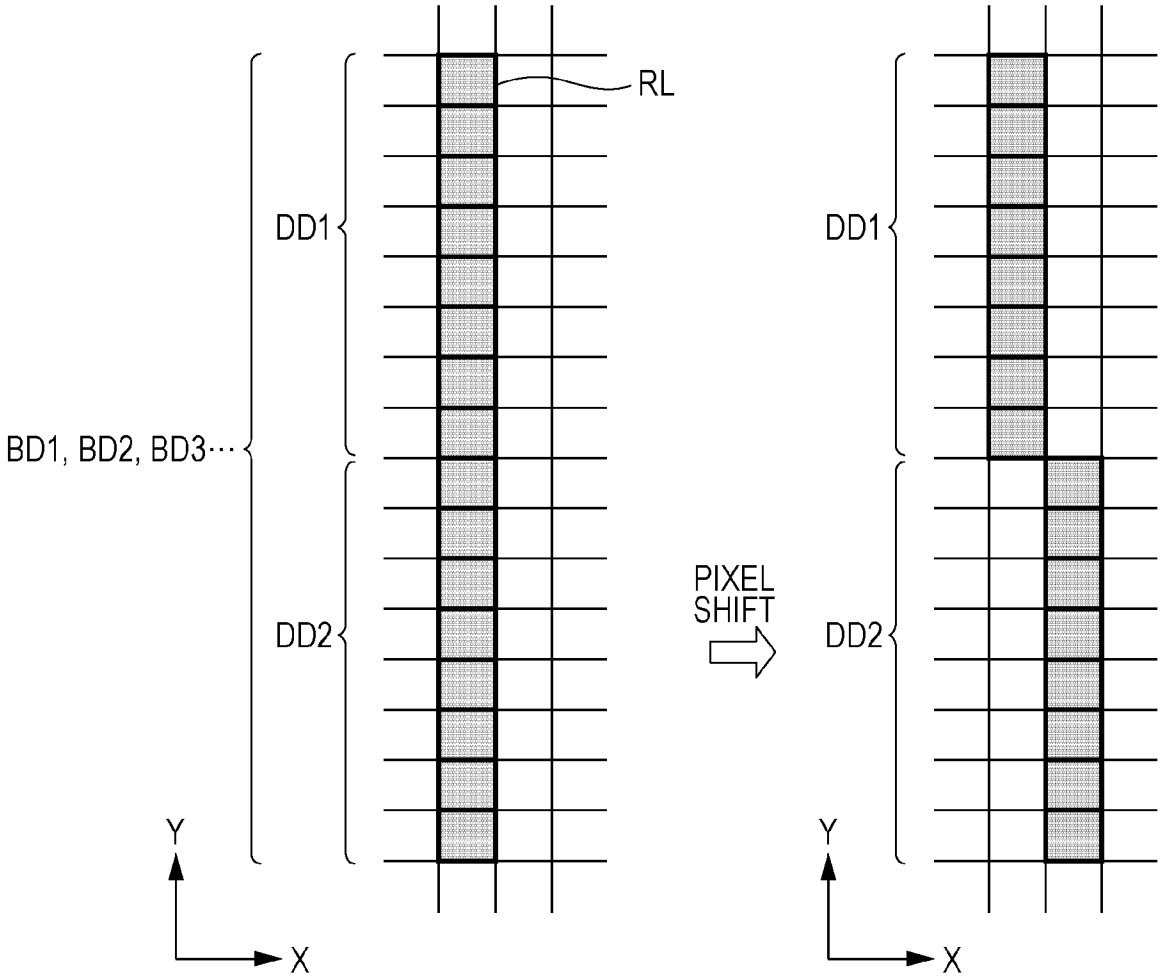
FIG. 9 is an illustrative diagram of a pixel shift when the liquid ejecting head is negatively inclined.

FIG. 9 is an illustrative diagram of the in-band pixel shift when the liquid ejecting head 16 is negatively inclined. The example of FIG. 9 differs from that of FIG. 8 in that a rear one of divisional data elements DD1 and DD2, or the divisional data element DD2, is displaced in the direction X by a preset number of pixels (one pixel in the second embodiment). The in-band pixel shift described above is performed at the timing of Step S130, as will be described below.

Figure 10:
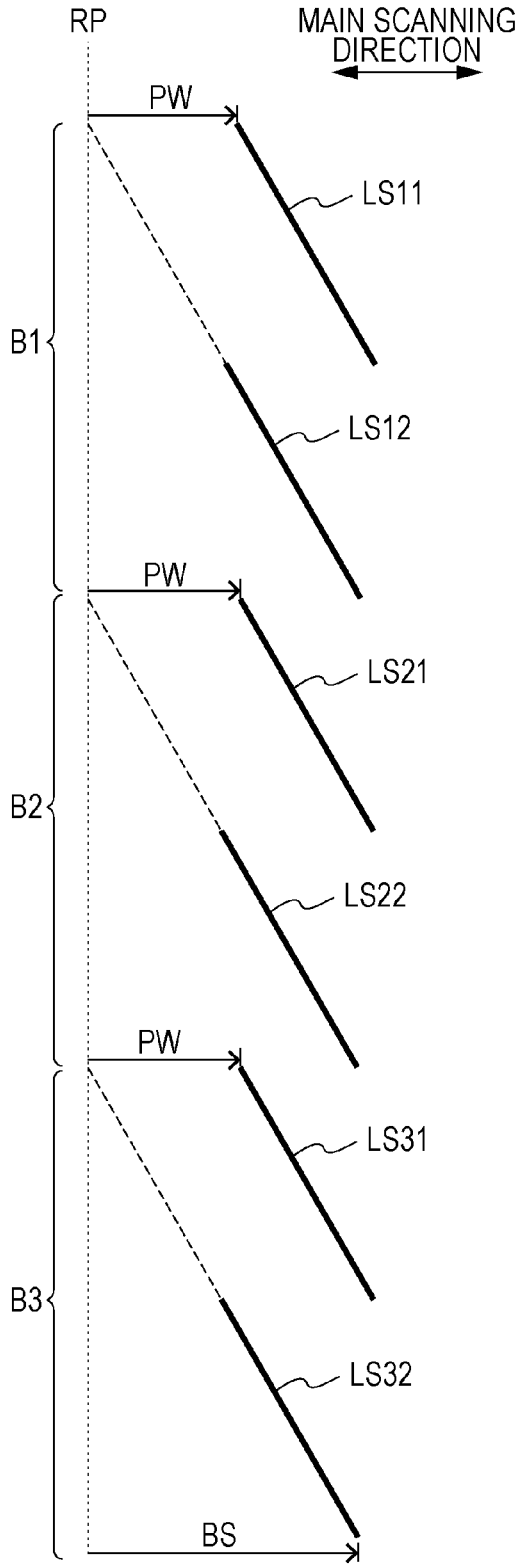
FIG. 10 illustrates an exemplary recorded result when a pixel shift is applied to each band but no shift amount is applied.

In determining the inter-band shift amount at Step S120 as described above, the controller 11 needs to consider the influence of the in-band pixel shifts that will be performed at Step S130. FIG. 10 illustrates an exemplary recorded result when the liquid ejecting head 16 is positively inclined. Specifically, the in-band pixel shift is applied to each band, but the shift amount BSn for each band data element is set to 0.

Referring to FIG. 10, a band B1, which is the recorded result of the band data element BD1, contains line segments LS11 and LS12 that constitute a part of the line RL. The line segment LS11 is the recorded result of the divisional data element DD1 obtained by dividing the band data element BD1 in accordance with the pixel shift; the line segment LS12 is the recorded result of the divisional data element DD2 obtained by dividing the band data element BD1 in accordance with the pixel shift. Note that the inclined dash line that is continued from the edge of the line segment LS12 is illustrated for reference in order to show the location at which the line segment LS11 would be recorded if the pixel shift were not applied to the divisional data element DD1, and is not actually present. Likewise, the dash lines continued from the edges of line segments LS22 and LS32 are illustrated for the reference. This also applies to the dash lines in FIGS. 11, 12A, 12B, 13A, 13B, 14A and 14B. The line RP indicates a location (reference location) of the front edge of the line segment LS11 in the divisional data element DD1 in the forefront one of the band data elements in the transport direction, or the front-end band data element BD1, before the pixel shift is applied. The shift amount for each band data element which will be described with reference to FIG. 11 and other drawings can be interpreted as the shift amount from the reference location RP. The double-headed arrow PW indicates the shift amount between the divisional data elements DD1 and DD2 which is generated by the pixel shift. In this case, this shift amount PW is nearly equal to the length of a pixel in the main scanning direction. The shift amount PW, which depends on the print resolution dpi of the recording apparatus 10 in the main scanning direction, is approximately 42 μm, for example.

The foregoing description may also apply to bands B2, B3 and so on that are recorded results for the band data elements BD2, BD3 and so on, respectively. More specifically, the band B2 contains a line segment LS21 and the line segment LS22 that constitute a part of the line RL. The line segment LS21 is the recorded result of the divisional data element DD1 obtained by dividing the band data element BD2 in accordance with the pixel shift; the line segment LS22 is the recorded result of the divisional data element DD2 obtained by dividing the band data element BD2 in accordance with the pixel shift. Likewise, the band B3 contains a line segment LS31 and the line segment LS32 that constitute a part of the line RL. The line segment LS31 is the recorded result of the divisional data element DD1 obtained by dividing the band data element BD3 in accordance with the pixel shift; the line segment LS32 is the recorded result of the divisional data element DD2 obtained by dividing the band data element BD3 in accordance with the pixel shift. According to these recorded results in FIG. 10, the line segments are disconnected from one another, failing to constitute the line RL. However, the controller 11 in the second embodiment enables the connection of line segments, as in the example of FIG. 11.

Figure 11:
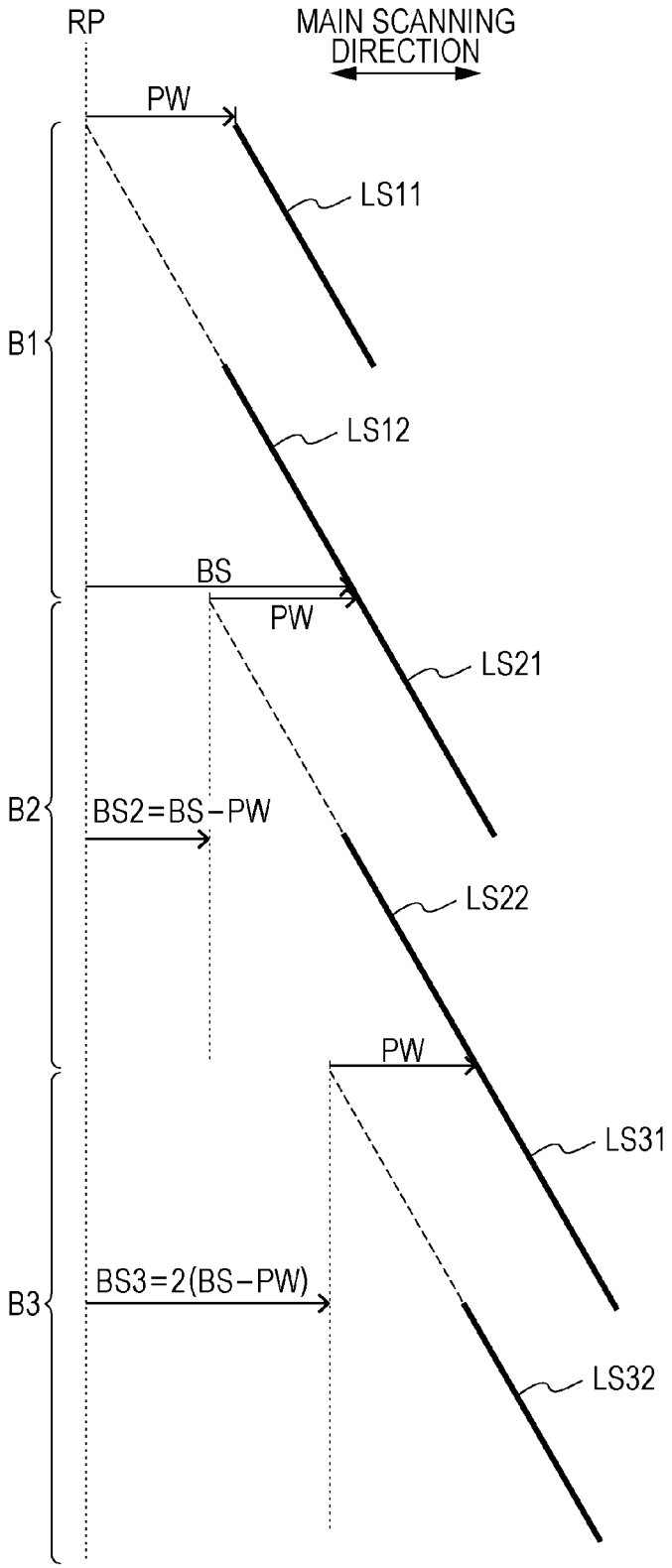
FIG. 11 schematically illustrates an exemplary recorded result in the second embodiment.

FIG. 11 illustrates an exemplary recorded result when the liquid ejecting head 16 is positively inclined, similar to the example of FIG. 10. Specifically, the in-band pixel shift is applied to each band, and the inter-band shift amount BSn is further applied to each band data element. In the second embodiment, the shift amount BSn for an n-th band data element BDn is basically set such that the divisional data element DD1 in the n-th band data element BDn is connected to the divisional data element DD2 in the (n−1)-th band data element BDn−1. Specifically, the shift amount BSn is calculated from equation (3) described below.

$$BSn=(n-1)\cdot BS' \tag{3}$$

In this equation, BS'=BS−PW. More specifically, the difference between the shift amount BS for each band which is determined in the first embodiment and the shift amount PW determined by the pixel shift corresponds to the shift amount BS' for each band in the second embodiment.

At Step S130, the controller 11 forwards the print data PD to the head driver 15 in units of band data elements, together with the shift amounts BS1, BS2, BS3 and so on determined in Step S120, as in the first embodiment. The head driver 15 receives the band data elements and then subjects the band data elements to the pixel shift when temporarily storing them in the buffer. Specifically, if a positive shift amount BSn is related to a band data element BDn, the controller 11 displaces the entire divisional data element DD1, which is obtained by dividing the band data element BDn as illustrated in FIG. 8, in the direction X by one pixel, and then writes it into the buffer. If a negative shift amount BSn is related to a band data element BDn, the controller 11 displaces the entire divisional data element DD2, which is obtained by dividing the band data element BDn as illustrated in FIG. 9, in the direction X by one pixel, and then writes it into the buffer.

At Step S140, both the head driver 15 and the liquid ejecting head 16 cooperate to record an image element based on the band data elements that have been received and undergone the pixel shift at Step S130. More specifically, the head driver 15 generates the drive voltage, based on the band data elements that have undergone the pixel shift and temporarily stored in the buffer and then applies it to the liquid ejecting head 16. In this way, the respective image elements, each of which is based on the divisional data elements DD1 and DD2 constituting a single band, are recorded while being displaced from each other in the main scanning direction by one pixel. In the second embodiment, the head driver 15 also adjusts the recording timing (liquid ejection timing) for the image element based on the band data element BDn, in accordance with the shift amount BSn. Consequently, the recorded result of the line segments constituting the line RL, as in the example of FIG. 11, can be acquired to the extent that their connection can be recognized. Applying the pixel shifts to each band in this manner, when the liquid ejecting head 16 is inclined, reduces the distance between the front and rear edges of the line RL in the main scanning direction. This can prevent an occurrence of a disadvantage, for example, that the entire line RL is not printed within the recording medium G.

If a blank BL (see FIG. 4B) is formed between a first image and a second image, the recording controller in the second embodiment reduces the shift amount for the second image (the band data element used to record the second image). More specifically, the controller 11 sets the shift amounts for a band data element BD3 and so on that come after the blank BL so that they become smaller than the shift amounts according to the actual locations of the band data element BD3 and so on within the print data PD.

Figure 12A:
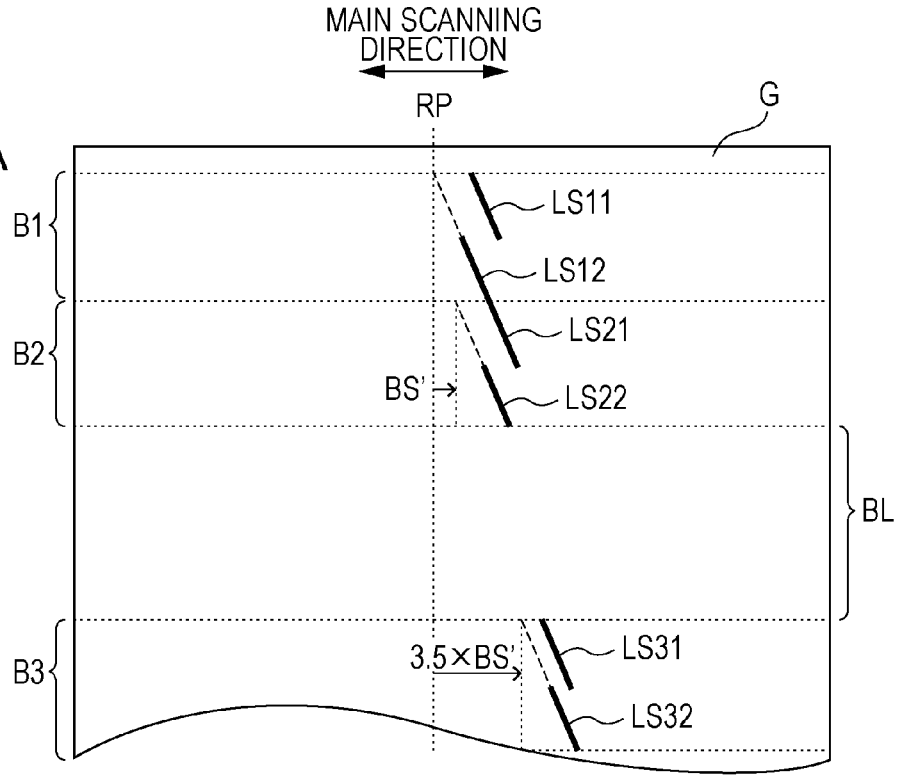
FIG. 12A illustrates an exemplary recorded result when a blank is present but a shift amount is not reduced.

The shift amount for a band data element BD2 preceding the blank BL is 1×BS'. If the blank BL is handled as a band data element containing any given image, the shift amount for the blank BL is 2×BS'. Thus, the shift amount for the band data element BD3 coming immediately after the blank BL which is determined based on its actual location is 3.5×BS'; this value is obtained by adding the shift amount (1.5×BS') according to the width (1.5 times band width) of the blank BL to 2×BS'. FIG. 12A illustrates an exemplary recorded result of applying the shift amount for the band data element BD3 which is determined based on its actual location in the above manner to a pass in which the band data element BD3 is recorded.

As described above, the controller 11 sets the shift amounts for the band data element BD3 and so on that come after the blank BL so that they become smaller than the shift amounts according to the actual locations of the band data element BD3 and so on within the print data PD. More specifically, assuming that the edge of a line segment LS31 contained in the band B3 which is closer to the blank BL is a first edge and the edge of a line segment LS22 contained in the band B2 which is closer to the blank BL is a second edge, the controller 11 sets the shift amount for the band data element BD3 so that the first edge is positioned nearer (aligned with) the second edge in the main scanning direction. The distance between the reference location RP and the edge of the line segment LS22 contained in the band B2 which is closer to the blank BL is BS'+BS. Accordingly, if the blank BL is present, the controller 11 sets the shift amount BS3 for the band data element BD3 to BS'+BS.

Figure 12B:
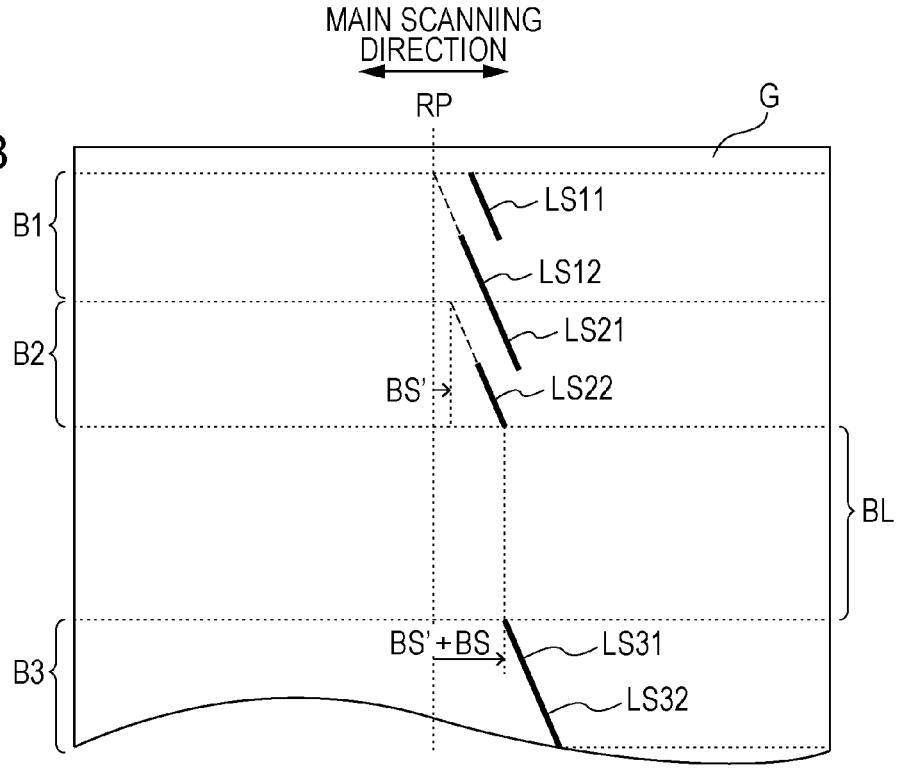
FIG. 12B illustrates an exemplary recorded result in the second embodiment when a blank is present (the liquid ejecting head is positively inclined).

FIG. 12B illustrates an exemplary recorded result of applying the shift amount for a band data element BD3 coming after a blank BL which is determined in the second embodiment to a pass in which the band data element BD3 is recorded. Referring to FIG. 12B, assuming that the edge of a line segment LS31 contained in a band B3 coming immediately after the blank BL which is closer to the blank BL is a first edge and the edge of a line segment LS22 contained in a band B2 preceding the blank BL which is closer to the blank BL is a second edge, the first edge is substantially aligned with the second edge in the main scanning direction. Suppose the shift amounts PW and BS are 42 μm as described above and 74 μm, respectively, a shift amount BS3 in the example of FIG. 12A is 3.5×BS'=112 μm whereas a shift amount BS3 in the example of FIG. 12B is BS'+BS=106 μm. Thus, the shift amount BS3 in the example of FIG. 12B is smaller.

When the liquid ejecting head 16 is positively inclined as in the examples of FIG. 12B, the recording controller in the second embodiment does not apply the pixel shift to the second image (band B3) disposed opposite the first image (band B2) with the blank BL therebetween. In other words, the pixel shift is not applied to both line segments LS31 and LS32 contained in the band B3 as in the example of FIG. 12B. A reason is that if the pixel shift is applied to the band data element BD3 disposed adjacent to the blank BL when the liquid ejecting head 16 is positively inclined, the edge of the line segment LS31 contained in the band B3 which is closer to the blank BL is positioned, in the main scanning direction, apart from the edge of the line segment LS22 contained in the band B2 which is closer to the blank BL, the bands B2 and B3 being arranged opposite each other with the blank BL therebetween. Comparing the examples of FIGS. 12A and 12B, the amount in the main scanning direction in FIG. 12B at which parts of the line RL (line segments LS22 and LS31) recorded with the blank BL therebetween are displaced from each other is smaller than that in FIG. 12A. Thus, it can be said that the example of FIG. 7B provides a user with a higher quality image.

Figure 13A:
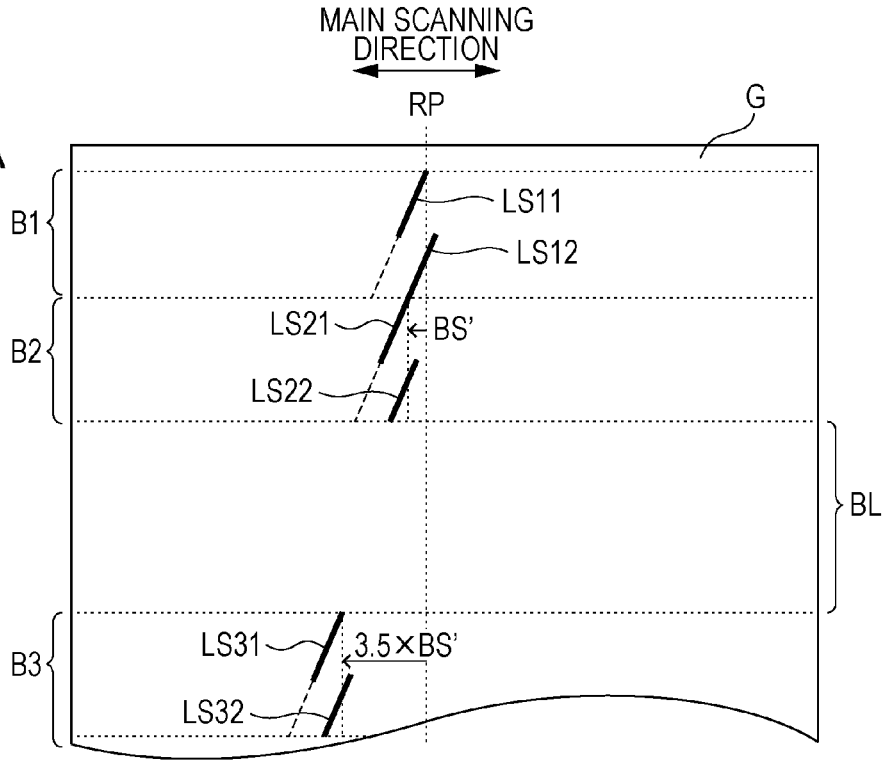
FIG. 13A illustrates an exemplary recorded result when a blank is present but a shift amount is not reduced.
Figure 13B:
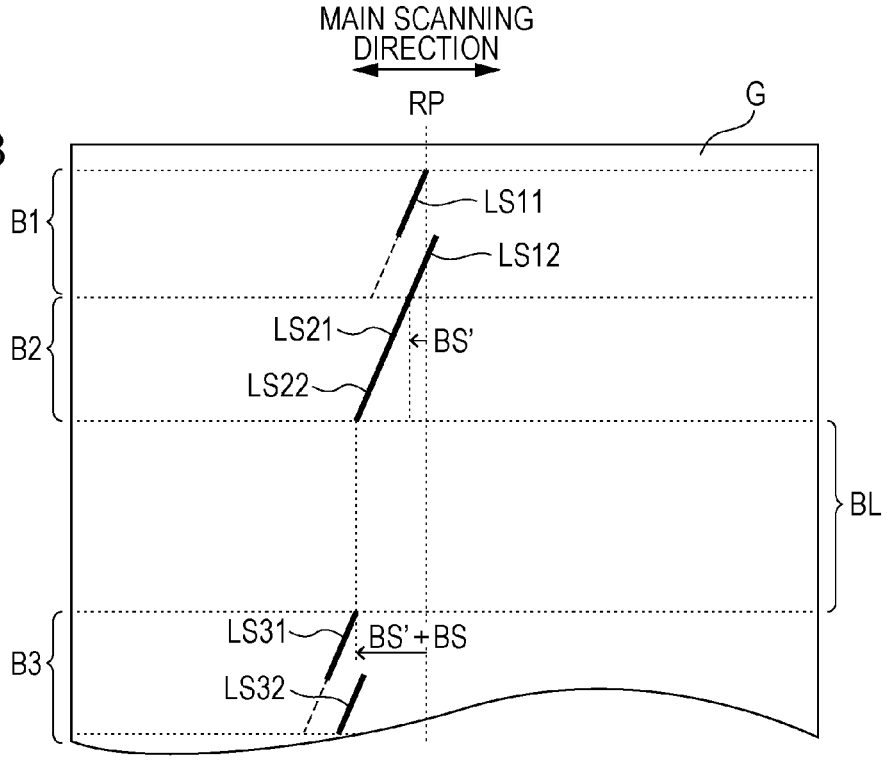
FIG. 13B illustrates an exemplary recorded result in the second embodiment when a blank is present (the liquid ejecting head is negatively inclined).

Like FIG. 12A, FIG. 13A illustrates an exemplary recorded result of applying the shift amount for a band data element BD3 which is determined based on its actual location in the above manner to a pass in which the band data element BD3 is recorded. Like FIG. 12B, FIG. 13B illustrates an exemplary recorded result of applying the shift amount for a band data element BD3 that comes immediately after a blank BL which is determined in the second embodiment to a pass in which the band data element BD3 is recorded. The examples of FIGS. 12A and 12B correspond to the case where the liquid ejecting head 16 is positively inclined; the examples of FIGS. 13A and 13B correspond to the case where the liquid ejecting head 16 is negatively inclined.

When the liquid ejecting head 16 is negatively inclined as in the examples of FIG. 13B, the recording controller in the second embodiment does not apply the pixel shift to the first image (band B2) disposed opposite the second image (band B3) with the blank BL therebetween. In other words, the pixel shift is not applied to both line segments LS21 and LS22 contained in the band B2 as in the example of FIG. 13B. A reason is that if the pixel shift is applied to the band data element BD2 disposed adjacent to the blank BL when the liquid ejecting head 16 is negatively inclined, the edge of the line segment LS22 contained in the band B2 which is closer to the blank BL is positioned, in the main scanning direction, apart from the edge of the line segment LS31 contained in the band B3 which is closer to the blank BL, the bands B2 and B3 being arranged opposite each other with the blank BL therebetween. Comparing the examples of FIGS. 13A and 13B, the amount in the main scanning direction in FIG. 13B at which parts of the line RL (line segments LS22 and LS31) recorded with the blank BL therebetween are displaced from each other is smaller than that in FIG. 13A. Thus, it can be said that the example of FIG. 7B provides a user with a higher quality image.

It can be said from the examples of FIGS. 12B and 13B that if a blank BL is formed between a first image and a second image, the recording controller divides the band data element corresponding to one of the first and second images into a plurality of divisional data elements DD1 and DD2. Then, the recording controller displaces (in a direction X) one of the plurality of divisional data elements DD1 and DD2 which is farther from the blank BL, with respect to the other of the divisional data elements DD1 and DD2 which is closer to the blank BL, the divisional data elements DD1 and DD2 expressing the one of the first and second images.

4. Other Embodiments

If the width of a blank BL in the transport direction is equal to or larger than a preset threshold regarding this width, the recording controller may reduce the shift amount for the band data element corresponding to a second image. Consequently, assuming that the edge of the second image which is closer to the blank BL is a first edge and the edge of a start image (band B1) recorded in a recording medium G through a first scan which is farther from the blank BL is a second edge, the first edge is positioned nearer the second edge in the main scanning direction. In other words, if the width of the blank BL has a certain length or above, the controller 11 sets the shift amount for a band data element BD3 coming immediately after the blank BL to approximately 0 at Step S120.

Figure 14A:
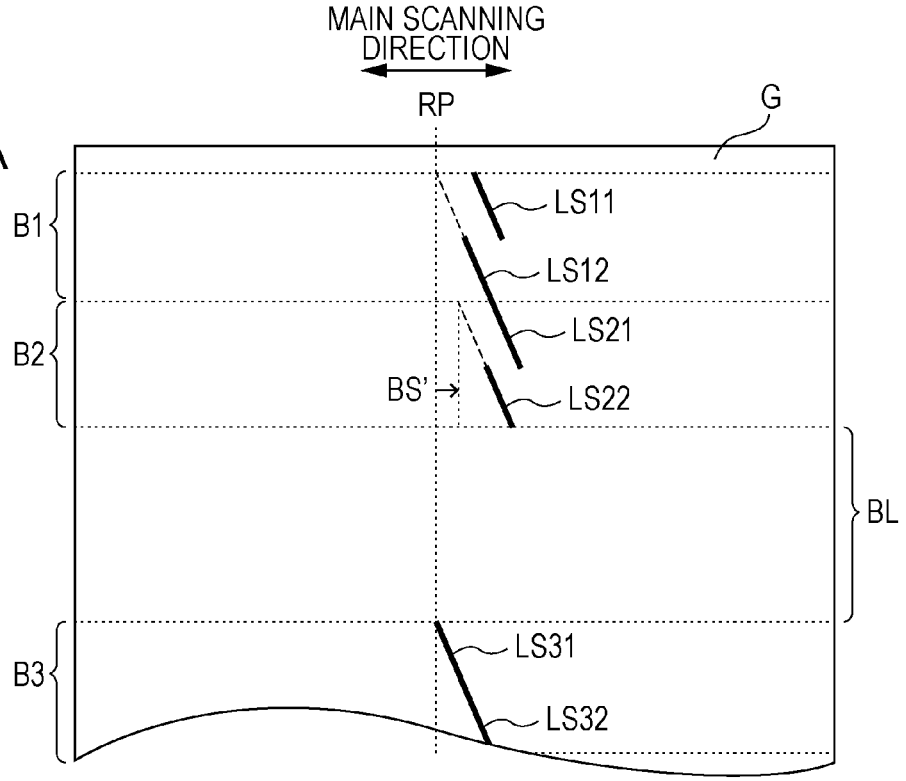
FIG. 14A illustrates an exemplary recorded result when a blank is present and a shift amount is set to 0 (the liquid ejecting head is positively inclined)
Figure 14B:
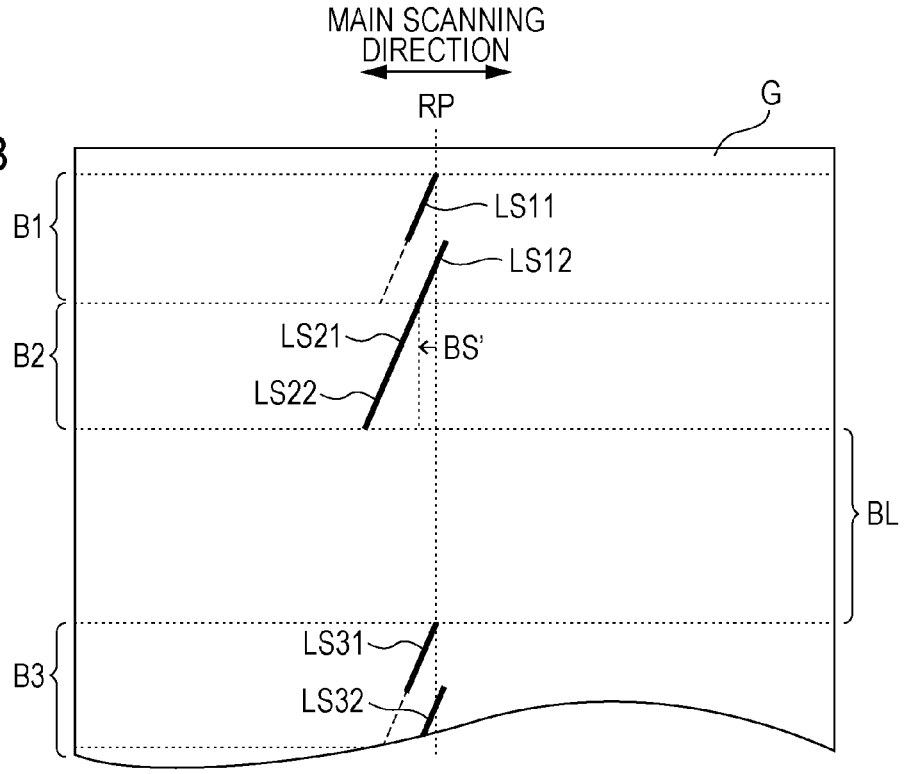
FIG. 14B illustrates an exemplary recorded result when a blank is present and a shift amount is set to 0 (the liquid ejecting head is negatively inclined).

In contrast to the example of FIG. 12B, FIG. 14A illustrates an exemplary case where the shift amount for a band data element BD3 coming immediately after a blank BL is set to 0. In contrast to the example of FIG. 13B, FIG. 14B illustrates an exemplary case where the shift amount for a band data element BD3 coming immediately after a blank BL is set to 0. If the width of the blank BL has a certain length or above in the transport direction, the misalignment in the transport direction is not reduced between the image elements in the band B3 and a band B2 formed on the rear and front sides, respectively, of the blank BL. Instead, the misalignment of the image element in the band B3 itself (with a reference location RP) in the transport direction is reduced. This can provide a user with a higher quality image when he or she checks the recorded result on all the pages. Note that the embodiment in which the shift amount for a band data element coming immediately after the blank BL is set to approximately 0 when the width of a blank BL has a certain length or above is also applicable to the first embodiment that does not involve a pixel shift.

The recording controller may variably reduce the shift amount for the band data element corresponding to a second image, depending on the location of a blank BL in the transport direction. If the width of the blank BL has a certain length or above, the controller 11 does not necessarily have to set the shift amount for the band data element BD3 coming immediately after the blank BL to 0 at Step S120, depending on the location of the blank BL in the transport direction. Instead, the controller 11 may set it to a considerable shift amount (e.g., greater than 0 and smaller than BS'+BS in FIG. 12B or 13B). More specifically, as the blank BL is positioned closer to the edge of the print data PD in the transport direction, the controller 11 may increase the shift amount for the band data element coming immediately after the blank BL. This is because if the liquid ejecting head 16 is inclined and the blank BL is positioned on the relatively rear side in the transport direction, the band data element coming immediately after the blank BL which is somewhat shifted from the reference location RP looks more natural. If this shift amount is set to 0, the resultant recorded image is likely to look strange.

For the in-band pixel shift, there is no limitation on the number of divisional data elements acquired by dividing a band data element. In addition, there is no limitation on the shift amount by which a divisional data element is displaced in the main scanning direction. Specifically, for the in-band pixel shift, as the inclination (absolute inclined amount) of the liquid ejecting head 16 increases, a band data element is preferably divided into a larger number of divisional data elements or a divisional data element is preferably displaced by a larger amount.

What is claimed is:

1. A recording apparatus that records an image onto a recording medium by repeating a process of ejecting liquid to the recording medium from a nozzle in a liquid ejecting head over a period in which the liquid ejecting head is scanning the recording medium in a first direction and a process of transporting the recording medium in a second direction, the second direction intersecting the first direction, the recording apparatus comprising:

an inclination acquisition section that acquires an inclination of the liquid ejecting head; and a recording controller that records a first image and a second image onto the recording medium through a first scan and a second scan, respectively, the first scan and the second scan being independent of each other, wherein the recording controller corrects a connection misalignment between the first image and the second image by displacing a recorded location of the second image in the first direction in accordance with the inclination, and the recording controller determines whether or not a non-recorded region where no dots are to be formed is present between the first image and the second image in the print data, and the recording controller reduces the displacement when a non-recorded region is present between the first image and the second image.

2. The recording apparatus according to claim 1, wherein the recording controller reduces the displacement so that an edge of the second image which is closer to the non-recorded region is positioned, in the first direction, nearer an edge of the first image which is closer to the non-recorded region.

3. The recording apparatus according to claim 1, wherein when a width of the non-recorded region in the second direction is equal to or larger than a preset threshold regarding this width, the recording controller reduces the displacement so that an edge of the second image which is closer to the non-recorded region is positioned, in the first direction, nearer an edge of a start image which is farther from the non-recorded region, the start image having been recorded onto the recording medium through an initial scan.

4. The recording apparatus according to claim 3, wherein the recording controller variably reduces the displacement, depending on a location of the non-recorded region in the second direction.

5. The recording apparatus according to claim 1, wherein the recording controller divides an image data element that expresses an image element recorded onto the recording medium through a single scan into a plurality of divisional image data elements in the second direction in accordance with the inclination, then displaces the divisional image data elements away from one another in the first direction, and records an image of the displaced divisional image data elements onto the recording medium through the single scan.

6. The recording apparatus according to claim 5, wherein when the non-recorded region is present between the first image and the second image, the recording controller divides an image data element corresponding to one of the first image and the second image into the plurality of divisional image data elements, and displaces one of the divisional image data elements which is farther from the non-recorded region with respect to another one of the divisional image data elements which is closer to the non-recorded region, the divisional data elements expressing the one of the first and second images.

7. A recording method of recording an image onto a recording medium by repeating a process of ejecting liquid to the recording medium from a nozzle in a liquid ejecting head over a period in which the liquid ejecting head is scanning the recording medium in a first direction and a process of transporting the recording medium in a second direction, the second direction intersecting the first direction, the recording method comprising:

acquiring an inclination of the liquid ejecting head; and recording a first image and a second image onto the recording medium through a first scan and a second scan, respectively, the first scan and the second scan being independent of each other, wherein in the recording of the first image and the second image, a connection misalignment between the first image and the second image is corrected by displacing a recorded location of the second image in the first direction in accordance with the inclination, a determination is made as to whether or not a non-recorded region where no dots are to be formed is present between the first image and the second image in the print data, and the displacement is reduced when a non-recorded region is present between the first image and the second image.

* * * * *